United States Patent [19]

Cava

[11] 4,340,792

[45] Jul. 20, 1982

[54] PENDANT CONTROL PROTECTOR

[76] Inventor: Frank P. Cava, 240 Beaver St., Beaver, Pa. 15009

[21] Appl. No.: 205,527

[22] Filed: Nov. 10, 1980

[51] Int. Cl.[3] ..... H01H 9/04

[52] U.S. Cl. ..... 200/304; 200/298

[58] Field of Search ..... 200/304, 298, 336

[56] References Cited

U.S. PATENT DOCUMENTS

| | | | |
|---|---|---|---|
| 1,420,065 | 6/1922 | Stillman | 272/35 |
| 2,168,908 | 8/1939 | Lewis | 293/55 |
| 2,330,684 | 9/1943 | Colling | 15/1 |
| 2,791,665 | 5/1957 | Baumbach | 200/168 |
| 3,135,233 | 6/1964 | Looker | 115/17 |
| 3,183,028 | 5/1965 | Williams | 293/62 |
| 3,598,437 | 8/1971 | Harris | 293/62 |

FOREIGN PATENT DOCUMENTS

| | | | |
|---|---|---|---|
| 829005 | 2/1949 | Fed. Rep. of Germany | 200/298 |
| 77624 | 4/1960 | France | 200/298 |
| 1057159 | 2/1967 | United Kingdom | 200/298 |

*Primary Examiner*—Willis Little

*Attorney, Agent, or Firm*—Webb, Burden, Robinson & Webb

[57] ABSTRACT

A protector for a pendant control is a protective cage formed by a pair of spaced ring-shaped bumpers joined by a plurality of connecting rods disposed around the bumpers. The cage is supported on the pendant control housing by a pair of spaced adjustable clamps, each clamp being attached to a bumper by at least two, and preferably three, shock absorbing members, such as coil springs, which are preferably disposed equidistant from one another about the bumpers and clamps to maintain the cage substantially concentric with the pendant control housing.

6 Claims, 3 Drawing Figures

PENDANT CONTROL PROTECTOR

BACKGROUND OF THE INVENTION

1. Field of the Invention

This invention relates to devices for protecting pendant controls of the type used to remotely operate trolleys in mills, or other industrial or commercial buildings and the like.

2. Description of the Prior Art

Overhead devices for moving materials are found in many mills, such as steel mills, factories, warehouses, stores and other industrial and commercial buildings. These devices, known as trolleys, overhead cranes, or hoists, are usually remotely operated from floor level through the use of a pendant control or switch which is suspended from the trolley by cable and electrically connected to mechanism, including a motor, on the trolley which causes the trolley to move in a desired direction on overhead rails, the trolley to move up and down and/or the overhead bridge to move in and out.

Since the pendant control must be low enough for an operator to reach it, it is also likely to be struck by other objects on the mill or building floor, for example, mill products being moved by forklift trucks, or to swing and strike other objects such as inventoried products like bars, coils, cartons, or scrap materials as it is being moved from one position to another. Hence, some sort of device is needed to protect the pendant control from being damaged.

Furthermore, it is desirable that the pendant control be caged or substantially covered in some manner to prevent accidental operation of the pendant control, which might cause undesired movement of a trolley on the overhead rails, resulting in possible injury to persons or property on the mill or building floor or near the rails.

U.S. Pat. No. 2,791,665 discloses one device for protecting pendant switches. That device is a protective housing or sheath of rubber or other yieldable material which encapsulates a switch or switches. The sheath is provided with openings through which pushbuttons of the switch can be actuated to control an overhead crane. Not only is the sheath more elaborate than necessary, and therefore more expensive, but is has several deficiencies. In the first place, the protective housing or sheath cannot be removed from the switches without disconnecting the electrical leads from the switches. Second, the metal tubular casing which extends through the sheath around the switches has a constant diameter. Hence, the same sheath cannot be used for all sizes of pendant switch housings which are or may become available. Third, the switches must be located in a specific position within the sheath in order for the pushbuttons to be accessible. Consequently, it may not be possible to substitute a switch of a different size having different pushbutton locations in the same sheath.

The present invention overcomes all of these deficiencies. It is a simple, fabricated, relatively inexpensive pendant control protector which can be easily installed and removed without disconnecting the electrical connection to the control, and which can accommodate any size of pendant control presently available or likely to be used in the foreseeable future.

Other advantages will become apparent from a reading of the following description of the invention.

SUMMARY OF THE INVENTION

The invention is a protector for a pendant control comprising a protective cage formed by a pair of spaced ring-shaped bumpers joined by a plurality of connecting rods disposed around the bumpers. The cage is supported on the pendant control housing by a pair of spaced adjustable clamps, or preferably worm drive clamps of the type used for clamping hoses and the like. Each clamp is attached to a bumper by at least two, and preferably three, shock absorbing members, such as coil springs. The springs are preferably disposed equidistant from one another about the bumpers and clamps to maintain the cage substantially concentric with the pendant control housing. The cage thus protects the pendant control against damage and prevents accidental actuation of the control.

DETAILED DESCRIPTION OF A PREFERRED EMBODIMENT OF THE INVENTION

Figure 1:
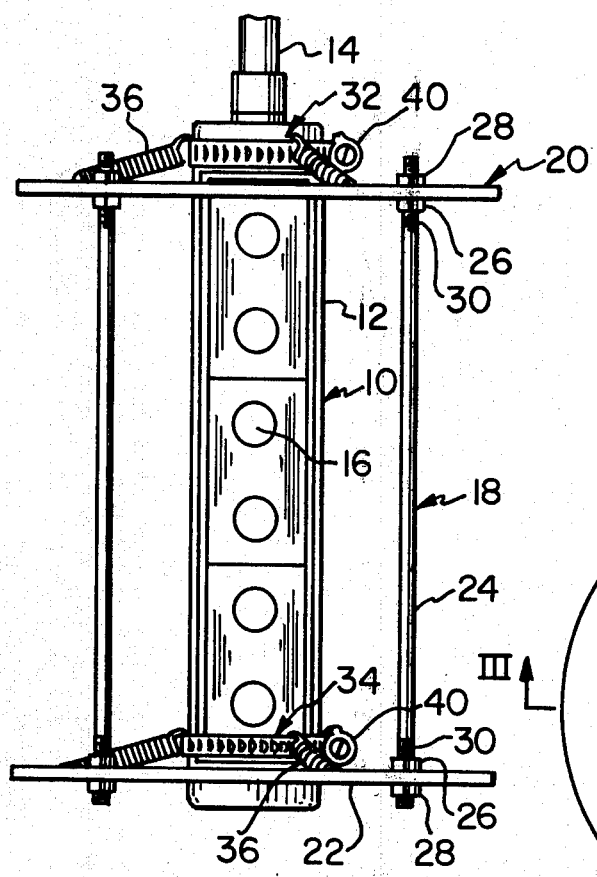
FIG. 1 is a side elevation view of the protector in accordance with the invention supported on a pendant control.
Figure 2:
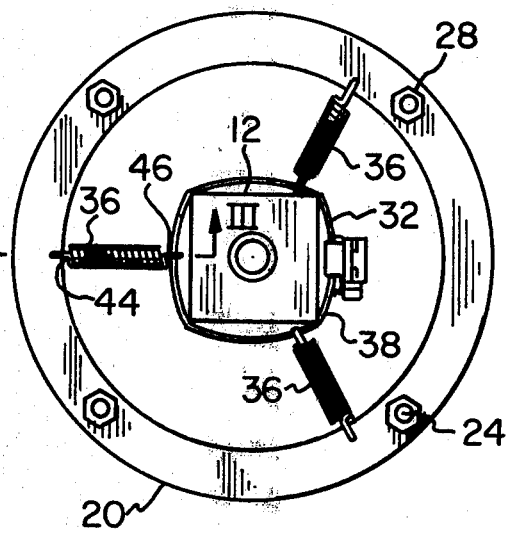
FIG. 2 is a top plan view of the protector and control shown in FIG. 1.

Referring to the drawings, a conventional pendant control 10 having a housing 12 suspended from a cable 14 includes pushbutton actuators 16 for remotely operating a trolley (not shown). A protector 18 according to the invention is supported on the pendant control housing 12.

The protector is a protective cage formed by a pair of ring-shaped bumpers, such as upper bar 20 and lower bar 22, preferably formed of rolled aluminum. The bumpers can be made from bar, tubing or other shapes and of other materials such as steel, plastic or the like, provided the materials are structurally strong and durable. The bars 20, 22 are joined to one another by a plurality of connecting rods 24 disposed around and inserted into holes in the bumpers. Preferably, there are four connecting rods as shown in the drawings; however, greater or fewer connecting rods may be used. Conventional means, such as nuts 26, 28 secured to threads 30 on opposite sides of the bars 20, 22 are used to join the rods to the bumpers.

The cage is supported on the housing 12 by a pair of clamps 32, 34 disposed around each end of the housing 12, respectively, and a plurality of shock absorbers, such as coil springs 36. Each clamp comprises a perforated metal band 38 having a conventional worm drive mechanism 40. The clamps are adapted to be tightened against the housing 12 by operating the worm drive mechanism.

The shock absorbers may be coil springs 36 or similar elastic or flexible means. There are at least two, and preferably three, springs 36 disposed equidistant from one another around the bars 20, 22. The cage is thus maintained substantially concentric with the pendant control housing 12.

Figure 3:
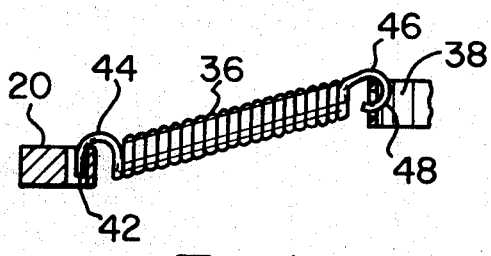
FIG. 3 is a cross-sectional view taken along the lines III—III of FIG. 2 showing the connections between the shock absorbing member and the bumper and clamp.

A typical connection of a coil spring 35 with a clamp and bumper is shown in FIG. 3. A hole 42 is provided in bar 20, and a hook 44 on one end of the spring 36 is engaged in the hole. A hook 46 on the opposite end of the spring is engaged in a hole 48 provided in the clamp 32. Six such connections are shown in the drawings. The normal weight of the cage causes the spring to assume an angle with respect to the clamp 32.

The protector can be installed or removed easily by releasing the clamps 32, 34 from the pendant control housing. Since the clamps are adjustable, the protector can accommodate pendant control housings of different sizes.

The protector prevents accidental damage to the pendant control by absorbing the shock of striking or being struck. It also prevents accidental operation of the pendant control, thus avoiding possible injury to persons and/or property.

Having described a presently preferred embodiment of the invention, it is to be understood that it may be otherwise embodied within the scope of the appended claims.

I claim:

1. A protector for a pendant control having a housing and comprising a protective cage, said cage formed by:

A. a pair of ring-shaped bumpers;

B. a plurality of connecting rods joined to and disposed about said bumpers to space them from one another;

C. a pair of adjustable clamps, each clamp being attached to a bumper by at least two shock absorbing members;

D. each member being disposed equidistant from one another about the bumpers and clamps; and E. said clamps and shock absorbing members supporting said bumpers on said pendant control housing to maintain the cage substantially concentric with said housing.

2. A protector as set forth in claim 1 wherein said shock absorbing members comprise coil springs.

3. A protector as set forth in claim 1 or claim 2 wherein there are three shock absorbing members.

4. A protector as set forth in claim 1 or claim 2 wherein said bumpers are formed of rolled aluminum bar.

5. A protector as set forth in claim 2 wherein said coil springs are provided with hooks at each end and said clamps and bumpers are provided with holes for engagement with said hooks to support said cage on the pendant control housing.

6. A protector as set forth in claim 1 wherein each of said adjustable clamps comprises a perforated metal band having a worm drive mechanism whereby the clamps can be tightened against the housing by operating the worm drive mechanism.

* * * * *